US007027900B2

(12) United States Patent
Kumar et al.

(10) Patent No.: US 7,027,900 B2
(45) Date of Patent: Apr. 11, 2006

(54) ENHANCED LOCOMOTIVE ADHESION CONTROL

(75) Inventors: Ajith K. Kumar, Erie, PA (US); Bret Worden, Union City, PA (US)

(73) Assignee: General Electric Company, Schenectady, NY (US)

( * ) Notice: Subject to any disclaimer, the term of this patent is extended or adjusted under 35 U.S.C. 154(b) by 310 days.

(21) Appl. No.: 10/666,300

(22) Filed: Sep. 19, 2003

(65) Prior Publication Data

US 2005/0065701 A1 Mar. 24, 2005

(51) Int. Cl.
*G06F 19/00* (2006.01)
*B61C 15/08* (2006.01)

(52) U.S. Cl. ..... 701/19; 701/82; 318/52; 291/2; 180/197

(58) Field of Classification Search ..... 701/19, 701/20, 82; 246/182 C, 182 R; 291/2; 318/52, 318/362; 180/197; 303/20, 151
See application file for complete search history.

(56) References Cited

U.S. PATENT DOCUMENTS 4,799,161 A * 1/1989 Hirotsu et al. ..... 701/70
4,896,090 A * 1/1990 Balch et al. ..... 318/52
4,936,610 A * 6/1990 Kumar et al. ..... 291/2
4,944,539 A * 7/1990 Kumar et al. ..... 291/2
5,117,163 A * 5/1992 Sandberg ..... 318/52
5,661,378 A * 8/1997 Hapeman ..... 318/52
5,841,254 A * 11/1998 Balch et al. ..... 318/430
6,028,402 A * 2/2000 Kumar et al. ..... 318/52
6,163,121 A 12/2000 Kumar et al.
6,208,097 B1 * 3/2001 Reddy et al. ..... 318/52
6,893,058 B1 * 5/2005 Kumar et al. ..... 291/2
2004/0060375 A1 * 4/2004 Kumar et al. ..... 73/865.9

* cited by examiner

*Primary Examiner*—Gary Chin
(74) *Attorney, Agent, or Firm*—John L. DeAngelis, Jr.; Beusse Brownlee Wolter Mora & Maire, P.A.

(57) ABSTRACT

A method of dynamically controlling traction of a locomotive (V) having a plurality of axles (A1–A6) on each of which are mounted wheels (W) for moving the locomotive over a set of rails (R). A creep control signal (creep_n) is provided to a controller (TMTC) for each axle to move the locomotive over the rails, the creep control signal being a function of adhesion operation characteristics (tractive effort, torque, creep) for that axle. An advisory signal (ccc_n) combining values representative of the adhesion quality of the two axles is provided to the controller to maximize the tractive effort of the axle if the adhesion quality of the other axle is a maximum for the current rail conditions. This reduces the amount of time for the axle to attain its maximum tractive effort when rail conditions change.

29 Claims, 9 Drawing Sheets

| | TE_M> TE_L | TE_T> TE_L | TE_L> TE_M | TE_T> TE_M | TE_L> TE_T | TE_M> TE_T |
|---|---|---|---|---|---|---|
| MOVE LEAD CREEP TOWARD MIDDLE | Y | | | | | |
| MOVE LEAD CREEP TOWARD TRAIL | | Y | | | | |
| MOVE MIDDLE CREEP TOWARD LEAD | | | Y | | | |
| MOVE MIDDLE CREEP TOWARD TRAIL | | | | Y | | |
| MOVE TRAIL CREEP TOWARD LEAD | | | | | Y | |
| MOVE TRAIL DREEP TOWARD MIDDLE | | | | | | Y |

| | Adh_M> Adh_L | Adh_T> Adh_L | Adh_L> Adh_M | Adh_T> Adh_M | Adh_L> Adh_T | Adh_M> Adh_T |
|---|---|---|---|---|---|---|
| MOVE LEAD CREEP TOWARD MIDDLE | Y | | | | | |
| MOVE LEAD CREEP TOWARD TRAIL | | Y | | | | |
| MOVE MIDDLE CREEP TOWARD LEAD | | | Y | | | |
| MOVE MIDDLE CREEP TOWARD TRAIL | | | | Y | | |
| MOVE TRAIL CREEP TOWARD LEAD | | | | | Y | |
| MOVE TRAIL DREEP TOWARD MIDDLE | | | | | | Y |

| | qprox_m_n_matrix | | | | | |
|---|---|---|---|---|---|---|
| | ADVISE FROM AXLE | | | | | |
| ADVISE TO AXLE | 1 | 2 | 3 | 4 | 5 | 6 |
| 1 | 0.00 | 1.00 | 0.50 | 0.33 | 0.25 | 0.20 |
| 2 | 1.00 | 0.00 | 1.00 | 0.50 | 0.33 | 0.25 |
| 3 | 0.50 | 1.00 | 0.00 | 1.00 | 0.50 | 0.33 |
| 4 | 0.33 | 0.50 | 1.00 | 0.00 | 1.00 | 0.50 |
| 5 | 0.25 | 0.33 | 0.50 | 1.00 | 0.00 | 1.00 |
| 6 | 0.20 | 0.25 | 0.33 | 0.50 | 1.00 | 0.00 |

| AXLE | weight | adh | adh_exp |
|---|---|---|---|
| 1 | 67000 | 0.225 | 0.2125 |
| 2 | 68000 | 0.216 | 0.2295 |
| 3 | 69000 | 0.2755 | 0.2465 |
| 4 | 70000 | 0.2635 | 0.2635 |
| 5 | 71000 | 0.231 | 0.2805 |
| 6 | 72000 | 0.322 | 0.2975 |

| | q_adh_m_n matrix | | | | | |
|---|---|---|---|---|---|---|
| | ADVISE FROM AXLE | | | | | |
| ADVISE TO AXLE | 1 | 2 | 3 | 4 | 5 | 6 |
| 1 | 0.00 | 0.00 | 0.06 | 0.00 | 0.00 | 0.02 |
| 2 | 0.13 | 0.00 | 0.19 | 0.06 | 0.00 | 0.15 |
| 3 | 0.00 | 0.00 | 0.00 | 0.00 | 0.00 | 0.00 |
| 4 | 0.06 | 0.00 | 0.12 | 0.00 | 0.00 | 0.08 |
| 5 | 0.29 | 0.14 | 0.36 | 0.21 | 0.00 | 0.31 |
| 6 | 0.00 | 0.00 | 0.03 | 0.00 | 0.00 | 0.00 |

| | ccc_quality_m_n matrix | | | | | |
|---|---|---|---|---|---|---|
| | ADVISE FROM AXLE | | | | | |
| ADVISE TO AXLE | 1 | 2 | 3 | 4 | 5 | 6 |
| 1 | 0.00 | 0.00 | 0.03 | 0.00 | 0.00 | 0.00 |
| 2 | 0.13 | 0.00 | 0.19 | 0.03 | 0.00 | 0.04 |
| 3 | 0.00 | 0.00 | 0.00 | 0.00 | 0.00 | 0.00 |
| 4 | 0.02 | 0.00 | 0.12 | 0.00 | 0.00 | 0.04 |
| 5 | 0.07 | 0.05 | 0.18 | 0.21 | 0.00 | 0.31 |
| 6 | 0.00 | 0.00 | 0.01 | 0.00 | 0.00 | 0.00 |

| AXLE | crp | crp_exp |
|---|---|---|
| 1 | 0.15 | 0.2 |
| 2 | 0.2 | 0.13 |
| 3 | 0.0735 | 0.0845 |
| 4 | 0.05145 | 0.054925 |
| 5 | 0.16 | 0.035701 |
| 6 | 0.025211 | 0.023206 |

| | crp_m_n matrix | | | | | |
|---|---|---|---|---|---|---|
| | CREEP FROM AXLE | | | | | |
| TRANSLATED TO AXLE | 1 | 2 | 3 | 4 | 5 | 6 |
| 1 | 0.15 | 0.31 | 0.17 | 0.19 | 0.90 | 0.22 |
| 2 | 0.10 | 0.20 | 0.11 | 0.12 | 0.58 | 0.14 |
| 3 | 0.06 | 0.13 | 0.07 | 0.08 | 0.38 | 0.09 |
| 4 | 0.04 | 0.08 | 0.05 | 0.05 | 0.25 | 0.06 |
| 5 | 0.03 | 0.05 | 0.03 | 0.03 | 0.16 | 0.04 |
| 6 | 0.02 | 0.04 | 0.02 | 0.02 | 0.10 | 0.03 |

ENHANCED LOCOMOTIVE ADHESION CONTROL

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to traction control of railroad locomotives; and more particularly, to a system and method of enhancing locomotive adhesion control using creep and adhesion measurements of all the axles, and the proximity of an axle to each of the other axles to affect the adhesion of each individual axle.

Railroad locomotives must provide a great degree of traction under a wide range of rail conditions; i.e., dry, wet, icy, oily. Generating the maximum tractive effort of a locomotive, or a consist of locomotives, produces the most efficient and effective operation of the train. Developing the maximum tractive effort by a locomotive requires that each axle of the locomotive, which includes the traction motor and wheels associated with the axle, develops its maximum tractive effort.

In a moving train, developing the maximum tractive effort by each axle is a dynamic function dependent upon a number of factors some of which can be controlled, and some of which cannot. Among the latter are rail conditions. It will be appreciated by those skilled in the art that tractive effort is limited by the amount of contact friction between the wheels of the locomotive and the patch of rail over which the wheels are passing at any given moment. This amount of friction, in turn, depends such factors as the presence of contaminants (oil, or lubricants such as sand) on the rail or wheel, the shape (roundness) of the wheel, the shape of the rail, atmospheric temperature, and the normal force or weight imposed on an axle, among others.

Referring to FIG. 1, an exemplary railroad locomotive V has a forward truck or bogey K1, and a rearward truck K2. Each truck has multiple axles. In FIG. 1, three axles are shown with truck K1 having axles A1–A3, and truck K2, axles A4–A6. Wheels W are mounted on each end of each axle. The locomotive travels over a set of rails indicated generally R. In many locomotive configurations, the locomotive's wheels are driven by electric traction motors, as is well-known in the art. This allows for torque control to be separately established for each locomotive, for each set of axles, on a per axle basis, or on a per truck basis. Modern adhesion control systems attempt to maximize the tractive effort delivered to the rail by controlling the creep of the wheels through the amount of torque applied to the axles.

Creep is defined as follows:

$$\text{Creep} = \frac{\text{wheel } (W) \text{ speed} - \text{train speed}}{\text{train speed}}$$

In U.S. Pat. No. 6,163,121 which is assigned to the same assignee as the present application, there is described a method and traction control system for a locomotive which separately controls the allowable creep level of each axle; i.e., the axles A1–A6 in FIG. 1. In the control system described therein, the tractive effort generated by each axle (including its associated traction motor and wheels) is monitored. Control signals are then generated and supplied to the traction motor for the axle to produce the amount of creep necessary to achieve the maximum tractive effort.

A problem with current control systems is their response time to a change in road conditions. This time can be in excess of ten seconds between a change in rail conditions and the resulting system response to change traction motor operation to produce the maximum tractive effort for these new conditions. Accordingly, in a moving train, rail conditions may change significantly between a change in conditions is sensed and the system reacts to produce the maximum tractive effort for previous rail conditions.

Regardless of how torque control is applied; i.e., on a per axle, per set of axles, or per locomotive basis, adhesion control systems typically measure, directly or indirectly, the speed of each wheel together with the speed of the locomotive. Wheel speed and mathematical derivatives of wheel speed are then used, together with the measured or calculated locomotive speed, to adjust the amount of torque applied.

Referring to FIG. 2, adhesion is determined by the equation:

$$\text{Adhesion} = \frac{\text{tractive effort}}{\text{Weight of locomotive } V}$$

In FIG. 2, separate performance curves are presented for a variety of different rail conditions including a dry rail, a dry rail with sand on it, a wet rail, and a rail with oil on it. These curves are illustrative only, and those skilled in the art will understand that the actual relationship between friction and creep may be different. The respective curves are a measure of adhesion with respect to per unit creep for each of the different conditions. Peak points a, b, and c are indicated on the curves for a dry rail with sand, a dry rail, and a wet rail respectively. If a locomotive has individual axle torque control, as taught by the U.S. Pat. No. 6,163,121, the optimal creep level is separately controlled for each axle.

FIG. 3 is a simplified block diagram illustrating a prior art individual axle adhesion control system. In this system, a wheel creep controller WCC dynamically adjusts the amount of torque applied to an axle, with wheel creep being limited to a value established by a tractive effort maximizer TEM. Maximizer TEM dynamically adjusts the creep limit output value supplied to controller WCC, so to attain and maintain the peak values (a, b, c) for the respective adhesion curves shown in FIG. 2. Controller WCC, in turn, supplies a creep torque limit output to a traction motor torque controller TMTC, whose output drives a traction motor TM for the individual axle.

Axles A1–A6 on locomotive V travel over the rails R in a sequential fashion. The condition of rail R and the adhesion curves such as those in FIG. 2 vary from axle to axle for a number of reasons. These include:

a) rail cleaning due to wheel/rail contact patch interaction;

b) sand or friction enhancer applications to the rail;

c) wayside, on-board, rail, or flange lube applications;

d) differences in the normal force (including weight) on an axle; and, e) contact patch and trajectory changes (since all of the axles may not be traveling exactly over the same path on the rail all of the time)

FIG. 4 illustrates the adhesion of three sequential axles moving over a rail. In FIG. 4, the plots assume that there are no substantial differences in friction between the axles. FIG. 5 is an enlarged version of a portion of the plots in FIG. 4. In FIG. 5, the points indicated L, M, and T represent the axle creep for a respective leading axle L (A1 or A4), middle axle M (A2 or A5), and trailing axle T (A3, A6) on a truck (K1, K2). As shown in the Figure, leading and trailing axles L and T are not operating at their peak or optimal creep levels, while middle axle M is operating at its peak, optimal creep level. If various factors such as rail cleaning and normal force differences between the axles are negligible, then the creep value for the axle (axle M) producing a substantially higher tractive effort than the other two axles on the truck provides a goal target for the creep value the other two axles on the truck should attain.

FIG. 6 illustrates how creep limit values may be adjusted for individual axles to increase their respective tractive efforts. The present invention is directed to augment the adhesion control system shown in FIG. 3, and described in the U.S. Pat. No. 6,163,121. As described hereinafter, control information such as that shown in FIG. 6 is combined with the individual axle information; e.g., measured slope of an adhesion curve ($\Delta TE/\Delta creep$) for the particular axle, to couple all of the locomotive's axles together to improve the overall tractive effort of locomotive V.

BRIEF SUMMARY OF THE INVENTION

Briefly stated, the present invention is directed to a traction control system for a railroad locomotive to reduce the response time to changed operating conditions so to maintain the locomotive's tractive effort at a maximum level. The system achieves this by determining when an axle is producing at or near its maximum tractive effort for existing rail conditions and then advising the traction motors of other axles so they can more rapidly adjust their operations to produce the maximum tractive effort of their associated axles for those conditions. The system operates dynamically so too also rapidly respond to sensed changes in rail conditions.

The system utilizes quality of adhesion information (which includes creep, tractive effort, torque, etc.) obtained for each axle mounted on a truck, to improve the overall tractive effort of all the axles mounted on the locomotive. The system utilizes this adhesion quality information, and axle proximity information to influence overall locomotive adhesion to the set of rails over which the locomotive is traveling and thereby dynamically control the tractive capabilities of the locomotive. The invention operates on multiple levels: i.e., axle to axle; truck to truck; locomotive to locomotive (in a multiple locomotive consist); and, train to train (where one train passes over the same set of rails as the next train).

In the method of the invention, a creep control signal is provided to a traction controller for each axle to move the locomotive over the rails, the creep control signal being a function of adhesion control or performance characteristics for that axle. A coupled creep control signal whose signal characteristics are a function of the performance characteristics of each of the other axles influences or "advises" the creep control signal, this being done to achieve maximum tractive effort from each respective axle and to decrease the response time in which each axle reaches its maximum tractive effort when rail conditions change. The coupled creep control signal is a function of the adhesion operation of each axle, as well as the proximity of the respective axle to each of the other axles. Tractive effort and creep inputs from each of the axles are combined to create a matrix of coupled creep control values with the coupled creep control signal supplied for each particular axle being derived from this matrix of values. The information used in the matrix includes not only current information, but historical data as well. The information can be geographically specific (since rails and rail conditions differ by locale) and time specific (since rail conditions may differ from one time of the year to another).

Advantages of the traction control system include estimating the optimal creep for each axle, creep limits for each axle based upon what is happening with the other axles, quick response to large changes in rail surface friction, reduction in creep measurement errors, and better response to transient rail conditions.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
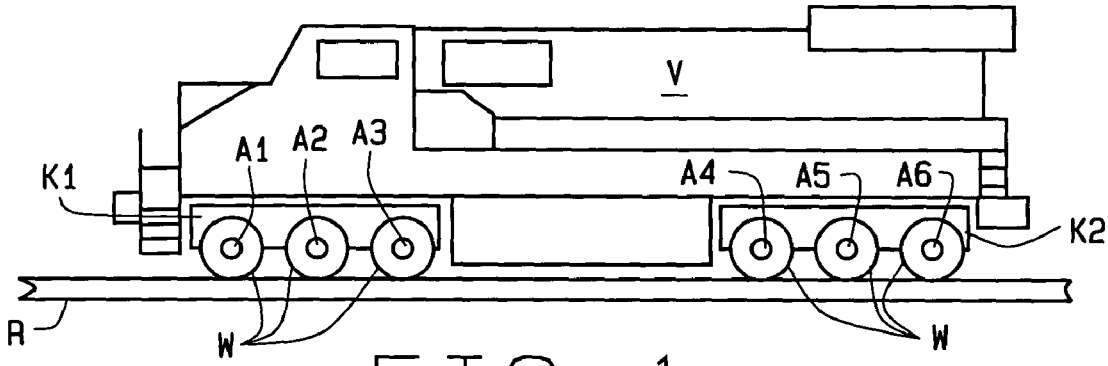
FIG. 1 is a representation of a railroad locomotive having a plurality of trucks with multiple axles on each truck.

Referring to the drawings, as previously described with respect to FIG. 1, a railroad locomotive V has a forward truck K1 and rearward track K2. Each truck supports three axles A1–A3 and A4–A6 respectively. An improved traction control system of the present invention is indicated generally 10 in FIG. 7. System 10 includes a coupled creep control unit (CCC) 12, which, for the locomotive of FIG. 1, is for a six axle locomotive having individual axle creep control. For this purpose, each axle has an associated tractive effort maximizer TEM1–TEM6 respectively. Control unit 12 supplies a separate signal to each maximizer. These signals ccc 1–ccc 6 are control signals respectively used to influence a creep limit output of each tractive effort maximizer so to produce the greatest amount of traction from the wheels W mounted on the end of each axle. It will be understood by those skilled in the art that locomotive V is representative only and that the locomotive could have more than two trucks shown in FIG. 1, and each truck can have more or fewer than three axles.

Each tractive effort maximizer TEM1–TEM6 incorporates a control logic that "searches" for the maximum tractive effort for the individual axle. The maximizer does this by adjusting the amount of creep present at the wheel W-rail R interface. One equation employed by a tractive effort maximizer TEM1–TEM6 to accomplish this is:

$$\text{Creep}_{limit}=\text{previous creep}_{limit}+\Delta t\times\text{sign}(m)\times(crp_{max}-crp_{min})\times K_1 \quad \text{(Eq.1)}$$

where,

Δt is a predetermined time interval for a discrete controller (not shown) of the tractive effort maximizer;

m is a control signal indicating the measured (or estimated) slope of an adhesion curve;

crp_max and crp_min are respective upper and lower limits on the range of creep movement for a slope m; and, $K_1$ is a gain (i.e., proportionality) factor controlling the rate at which the creep limit moves for a given slope m.

Figure 5:
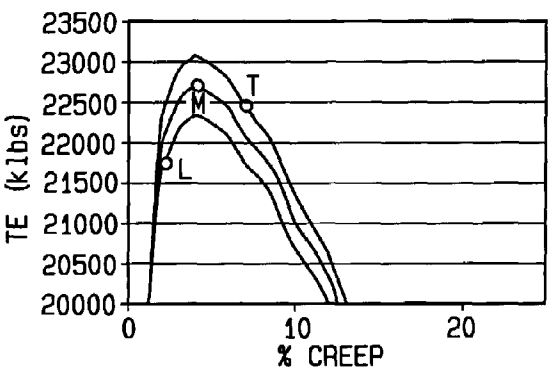

In prior art control systems such as taught by the U.S. Pat. No. 6,163,121, the creep limit factor is maintained at a substantially constant level. For an adhesion curve such as those shown in FIG. 5, the measured slope m may be either positive or negative depending upon where on the curve the adhesion control system is operating. For the curves shown in FIG. 5, a positive slope would be movement upward along the left side of the curve toward its peak; while a negative slope would be movement downward from the peak along the right side of the curve.

In accordance with the present invention, Eq. 1 is now augmented to incorporate a control effort provided by an algorithm exercised by coupled creep control unit 12. This is achieved by including a creep rate term $ccc_n$ (where n=axle number), and providing an output from control unit 12 to the tractive effort maximizer TEM for each axle. The resulting output is determined, for example, from Eq. 2., as follows:

$$\text{Creep}_{limit}=\text{previous creep}_{limit}+\Delta t\times(K_1\times m\times(crp_{max}-crp_{min})+ccc_n) \quad \text{(Eq. 2)}$$

Figures 6, 7:
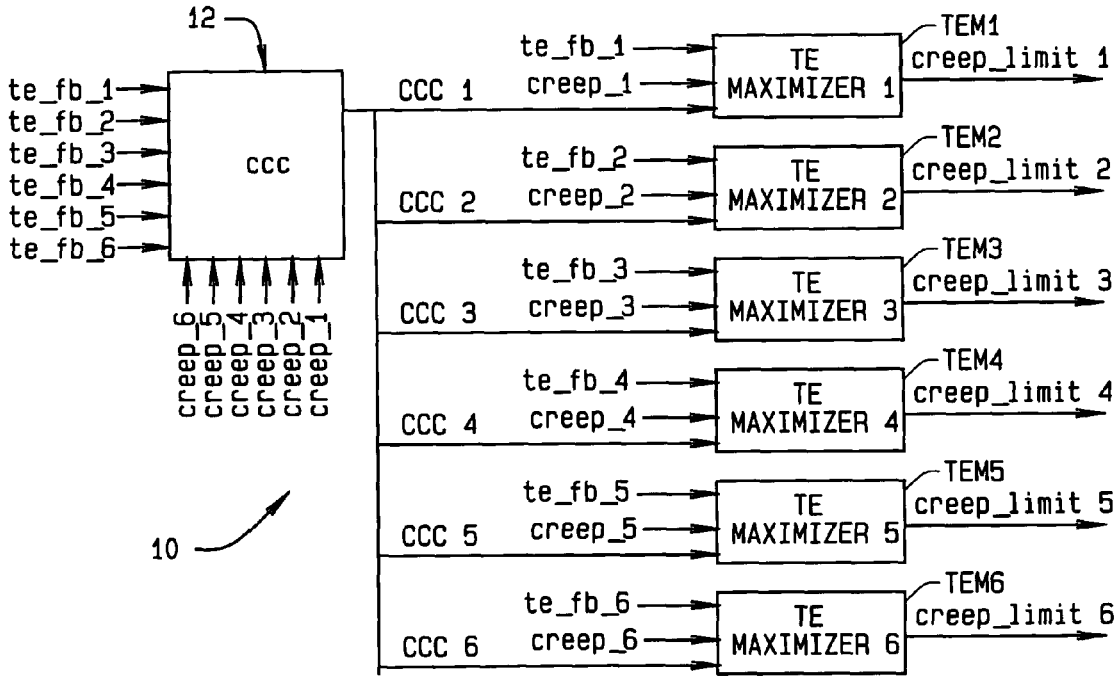
FIG. 6 is a chart for an enhanced adhesion control system of the present invention for coupling creep control information from one axle on a truck to other axles on the truck.
FIG. 7 is a block diagram of an enhanced adhesion control system of the present invention.

Referring to FIG. 7, coupled creep control unit 12 is provided with a tractive effort feedback signal te_fb_n for each axle, this signal also being supplied to the respective tractive effort maximizer TEM for that axle. The coupled creep control unit is also supplied a creep signal creep_n for each axle, this signal also being supplied to the respective tractive effort maximizer for that axle. As described hereinafter, control unit 10 combines the information contained in these signals to generate the $ccc_n$ signal supplied to a tractive effort maximizer TEM1–TEM6. Now, the creep limit signal supplied by each maximizer to the wheel creep controller for the traction motor for its associated axle is modified by operating conditions experienced by each of the locomotive's other axles, particularly when rail conditions change. Those skilled in the art will appreciate that the $cccn_n$ signal represents the combined effects (influence) of all the other axles on the rate of change of a target creep for a particular axle n. The combined creep control signal now modifies the creep limit output from the tractive effort maximizer and the creep control for that particular axle.

Figures 16, 17, 20:
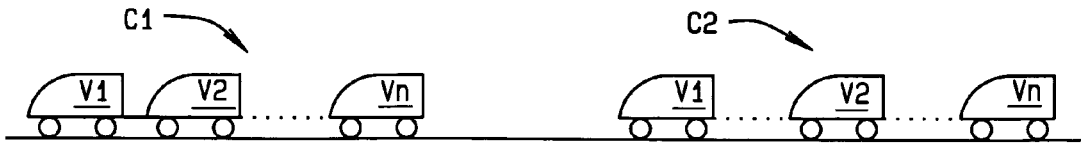
FIG. 16 is an advice matrix determined as a function of normalized axle adhesion values.
FIG. 17 is an advice matrix for the quality of coupled creep control based upon both normalized adhesion values of the axles, and the proximity of one axle to another.

Importantly, and as shown in FIG. 20, a train may include a number of locomotives V1–Vn located either adjacent each other, or at spaced intervals throughout a consist C1. Since each locomotive travels over the same track as the other locomotives in the consist, the information utilized to enhance the adhesion control of one locomotive in the consist, can be communicated to trailing locomotives in the consist and utilized by them as well for the same purpose. Communication systems to transmit information and data throughout a consist are known in the art and are not described. Further, the current invention contemplates providing adhesion control information for locomotives in one consist C1 to be communicated to locomotives in a trailing consist C2 for use by locomotives in the second consist as well. Thus, the present invention operates on several levels: i.e., axle to axle, truck to truck, locomotive to locomotive in a multiple locomotive consist, and train to train where one train proceeds over the same set of rails as the next train.

As described herein, the system and method of the invention utilize adhesion quality information (including, but not limited to, tractive effort, torque, and creep information) about an axle on the locomotive, and similar information about at least one other axle. This other axle can be on the same truck or one of the other trucks of the locomotive. However, it can be an axle on another locomotive in the consist, or an axle on a locomotive of another consist. In accordance with the invention, values representative of the adhesion quality of at least these two axles are combined to produce a signal which is supplied to the controller TMTC driving the axle on the locomotive to maximize the tractive effort of the axle. The adhesion information is used to maximize the tractive effort of each axle of the locomotive and to reduce the response time needed for an axle to re-attain its maximum tractive effort in response to changed rail conditions.

Figures 8, 9:
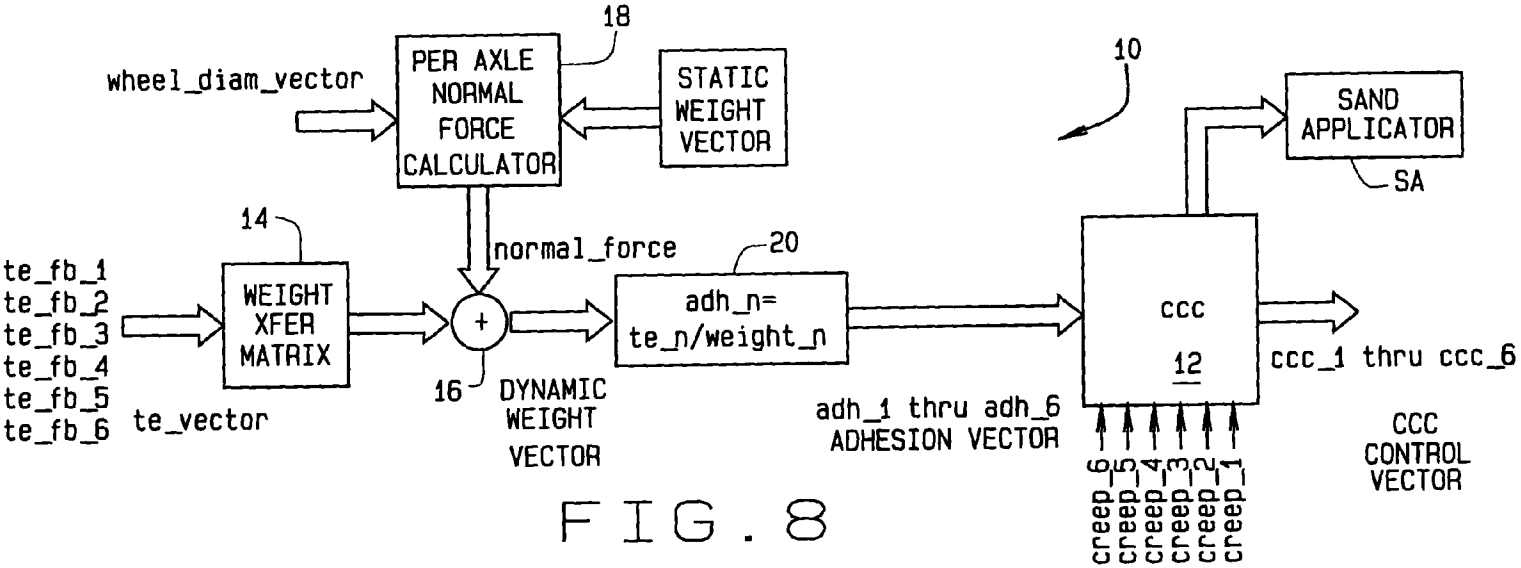
FIG. 8 is a block diagram of a portion of the control system illustrating how a weight compensated input is provided to a coupled creep control unit of the system.
FIG. 9 is a chart illustrating an example of coupled creep control utilizing information relating to adhesion of equal friction axles.

Static and dynamic weight shifts within truck K1 or K2, and locomotive V, will result in a different normal force for each axle. These force differences are compensated for by calculating the amount of adhesion for an axle (with calculated adhesion values then being used), rather than outputs from the tractive effort maximizer TEM for that axle. As shown in FIG. 8, each tractive effort feedback signal te_fb_n is provided as an input to a weight transfer matrix 14. The output of matrix 14 represents the normal force changes due to the dynamics of coupling the tractive effort of one axle with the normal force on another axle, and is provided as one input to a summer 16. A second input to the summer is a normal force value determined by a per axle normal force calculator 18. Calculator 18 has, as inputs, a static weight vector value and a wheel diameter vector value. (This represents the weight on each axle while locomotive V is at a standstill and not producing any traction forces). A dynamic weight vector value determined by summer 16 (which represents an instantaneous normal force of each axle) is provided as an input to a calculator 20. Using Eq. 3, calculator 20 calculates the amount of adhesion for the axle (adh_n) by dividing the tractive effort for the axle by the weight supported by the axle; i.e., $$adh_n = te_n / \text{weight}_n \quad \text{(Eq. 3)}$$

The resulting adhesion vector values for each axle are now supplied as inputs to control unit 12. Referring to FIG. 9, a chart is presented showing coupled creep control when the adhesion of equal friction axles is considered for a three axle truck such as truck K1 or K2, as an example. As shown in FIG. 9, if the adhesion of the middle axle in the truck is greater than that of the leading axle, then it is desirable to move the creep in the leading axle toward that of the middle axle. If the adhesion of the trailing axle in the truck is greater than that of the leading axle, then it is desirable to move the creep in the leading axle toward that of the trailing axle. If the adhesion of the leading axle is greater than that of the middle axle, then it is desirable to move the creep in the middle axle toward that of the leading axle. If the adhesion in the trailing axle greater than that in the middle axle, it is desirable to move the creep from the middle axle toward that of the trailing axle. If the adhesion in the leading axle is greater than that in the trailing axle, it is desirable to move creep from the trailing axle toward that of the leading axle. Finally, if the adhesion in the middle axle is greater than that in the trailing axle, then it is desirable to move the creep from the trailing axle toward that of the middle axle.

Figure 2:
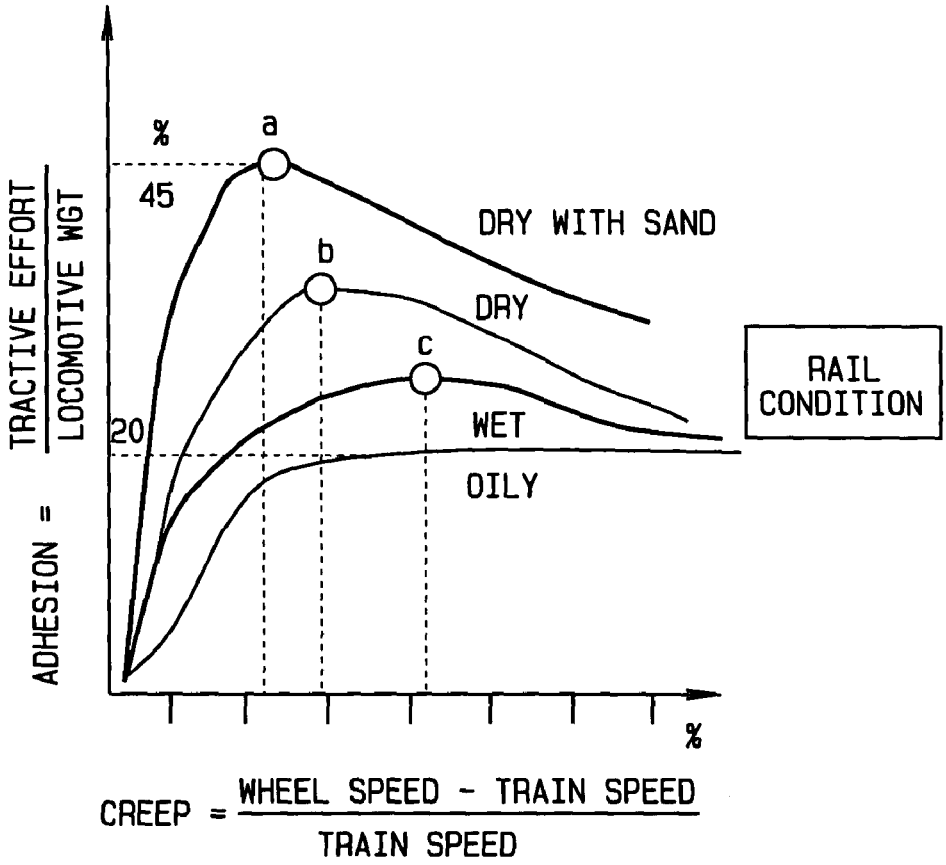
FIG. 2 is a graph of possible performance curves for different rail conditions listed, the curves measuring adhesion with respect to per unit creep.
Figure 3:
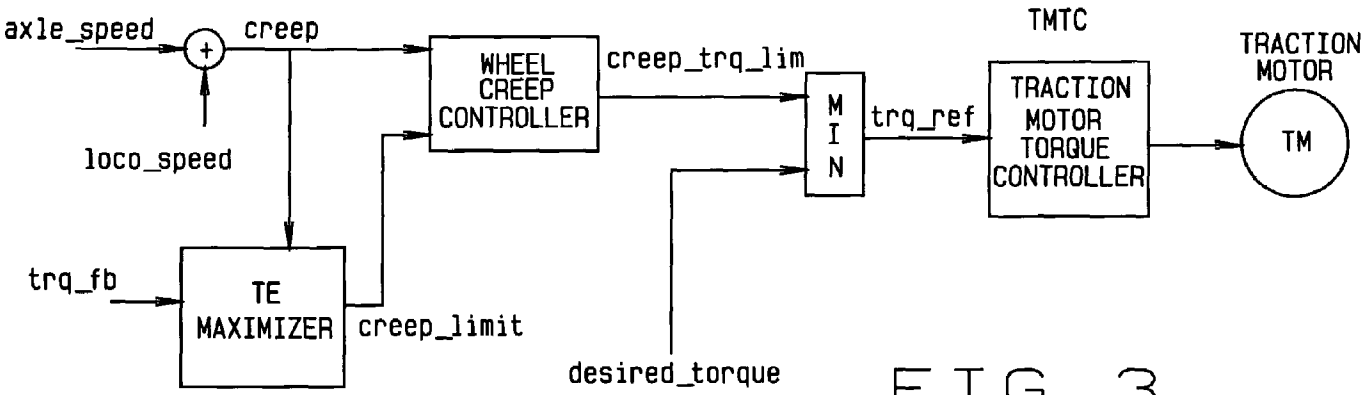
FIG. 3 PRIOR ART
FIG. 3 is a block diagram of a prior art adhesion control system for individual axles.
Figure 4:
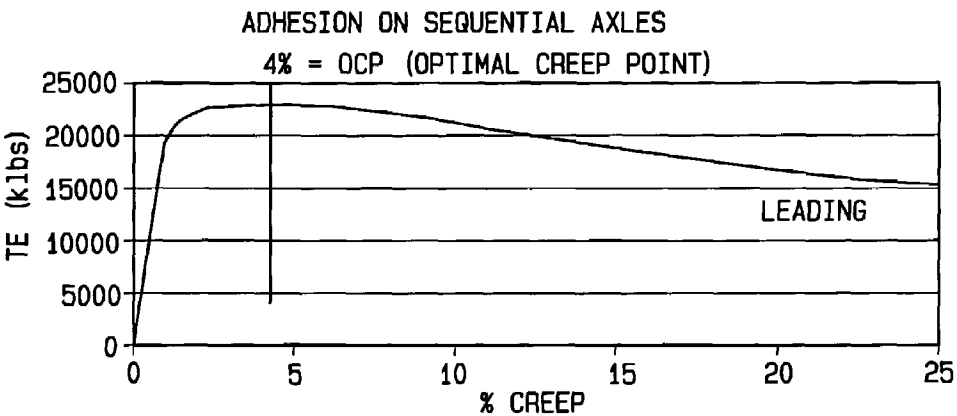
FIGS. 4 and 5 are example adhesion curves for sequential axles moving over a section of rail.
Figure 10:
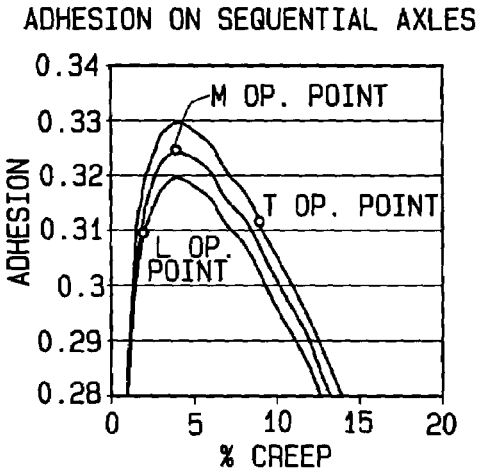
FIG. 10 is a graph of adhesion curves for three sequential axles having equal friction but supporting different weights.

Further with respect to the application of Eq. 2, adhesion curves are shown in FIG. 10 for a three axle truck configuration where there is equal friction, but an unequal weight distribution. Optimal operating points for each axle L, M, and T are shown in FIG. 10, again using FIG. 2 to determine the appropriate values.

Figure 11:
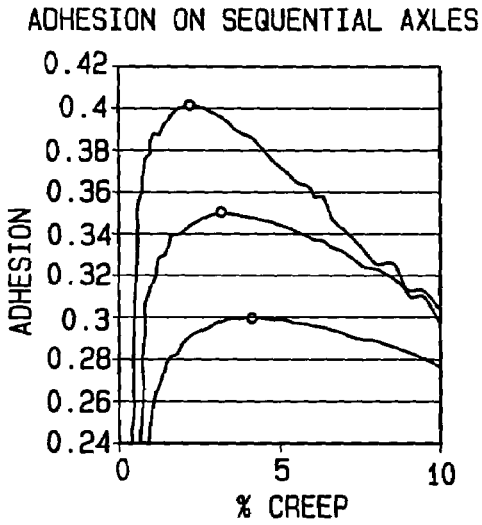
FIG. 11 is a graph similar to that of FIG. 10, but in which the axles have different friction characteristics.

In FIG. 11, a similar set of curves is shown for a three axle truck configuration where the axles now have different amounts of friction. The curves shown in FIG. 11 represent a typical situation encountered by a train traveling over a set of rails R. Those skilled in the art will appreciate that rail surface conditions commonly change from one axle to the next because of:

a) sand or friction enhancers applied at discrete points on the locomotive;

b) wheel creep effects on the rail surface; and, c) wayside, or on-board flange or "top of rail" lubricant applications.

In addition to the algorithm employed by control unit 12, as set forth in Eq. 2, other factors are also addresses by the control unit in producing outputs to the respective tractive effort maximizers. The first of these factors relates to large signal limits on creep changes. This situation arises because, while the level of creep associated with maximum adhesion is not the same for all axles, the difference in optimal creep levels is bounded, and can be estimated. This enables control unit 12 to account for the creep levels of axles with significantly higher tractive efforts than other axles, so to influence the creep levels of these other axles.

A second factor relates to the amount of adhesion of which an axle is capable. If a relationship between optimal creep levels for a sequential set of axles (A1–A3, or A4–A6) can be established (either through empirical or analytical means), then the creep limit of each axle is partially influenced by the creep limit of the other axles. This relationship can also be based on previous locomotive performance, including performance of other locomotives. It will be understood by those skilled in the art that locomotives of a similar type or model should exhibit common characteristics with other locomotives of the same class. This relationship could further be modeled based on the particular track, position in the track, and rail conditions including weather (all of which could be obtained from way side, on-board GPS and track maps), and the position of the locomotive in the train as noted with respect to FIG. 20. Thus, the relationship is a function of total locomotive tractive effort and/or position on the track.

The above relationship(s) is important because it prevents one axle from drifting into a low tractive effort, extreme creep region. This could occur, for example, with trailing truck K2 on locomotive V, where wheel rail cleaning and weight transfer creates an expectation of a tractive effort increase on axles A4 to A6, as the creep on these axles is reduced. If the tractive effort of axle A5, for example, then turns out to be less than that of axle A4, the result would be for the creep level of axle A5 to migrate toward that of axle A4. The same effect will also occur with respect to the creep level of axle A6 migrating toward that of axle A5.

A third factor is the response to significant changes in friction when a transport lag scheduled control effect occurs. An important advantage of adhesion control system 10 is its rapid response to the application of a lubricant by a wayside lubricator and the resultant immediate and sizeable reduction in rail surface friction that occurs. Since the lubrication is typically applied as locomotive V reaches the lubricator, lead axle A1 will first experience the resulting change in friction when the wayside lubricant is applied to rail R. In accordance with the invention, adhesion control system 10 reacts by increasing the magnitude of the creep level signals to the maximizers TEM1–TEM6, and by having sand applied to the rails in front of the wheels by a sand applicator SA (see FIG. 8). Once leading axles A1, A2 on truck K1 detect the changes in the rail condition, the control efforts of system 10 occur; but they occur after a delay that is directly proportional to the position of the axle (or sand applicator relative to the lead axles), and inversely proportional to the speed of the train. However, it is a feature of the invention to reduce this delay as much as possible so to improve response time to the changed set of conditions. In addition to axles on this locomotive and control actions (e.g., sanding) carried out by this locomotive, this information could, as noted above, also be obtained from other locomotives in the consist or from other trains which have passed over the same track, or from way side communications. The information could also be obtained from various sensors on the axles or truck, and from tractive effort and creep changes experienced by axles.

An important advantage of adhesion control system 10 is that by use of coupled creep control, the level of creep for one axle is now influenced by the level of creep for the other locomotive axles so to provide a unified or integrated axle creep control which further serves to reduce response time to changed conditions. The result is that in a six axle locomotive such as locomotive V, the adhesion of each axle is maximized and the creep level determined for each axle is optimal for the operating conditions currently being experienced by all the axles. This is because control unit 12 is responsive to information relating to all of the axles and integrates this information so the overall tractive effort attained through maximizer TEM1–TEM6 provides for the most efficient operation under the prevailing circumstances. Since the rail conditions vary from one moment to the next, adhesion control system 10 provides for dynamic creep control, and hence the dynamic traction capabilities of locomotive V.

The maximizer function can be erroneous for a number of reasons including:

a) an adhesion curve for an axle having more than one maxima;

b) creep measurement errors due to a variety of factors;

c) processing errors which may occur such as asynchronous sampling or numerical truncation within the algorithm;

d) rail condition transients;

e) wheel creep control (WCC) operations (e.g., moving in and out of creep control, or not allowing tractive effort maximizers TEM1–TEM6 sufficient time to reach an the optimal creep level); or, f) system instabilities that cause significant variation in operation of the tractive effort maximizers and the resulting creep signals they produce.

In operation, adhesion control system 10 effectively enables each tractive effort maximizer TEM1–TEM6 to provide creep "advice" to the five axles it does not control. This advice is weighted advice, and the amount of influence it has is a function of the following factors:

a) axles displaying the highest level of "normalized adhesion" characteristics are "trusted" most. Normalized adhesion means each axle's adhesion relative to its expected adhesion. Expected adhesion is, in turn, based upon the adhesion of the other five axles (of a six axle locomotive V), and the location of the particular axle on the locomotive.

b) the influence of the creep level of one axle to that of another axle, diminishes as the distance between the two axles increases. An axle adjacent to another axle will have more influence on the creep level of the adjacent axle than when the axles are at opposite ends of the locomotive. This is because of the increasing uncertainty of rail conditions between the respective axles.

Again, the overall effect is to reduce response time to changing conditions to maintain maximum tractive effort.

Figure 12:
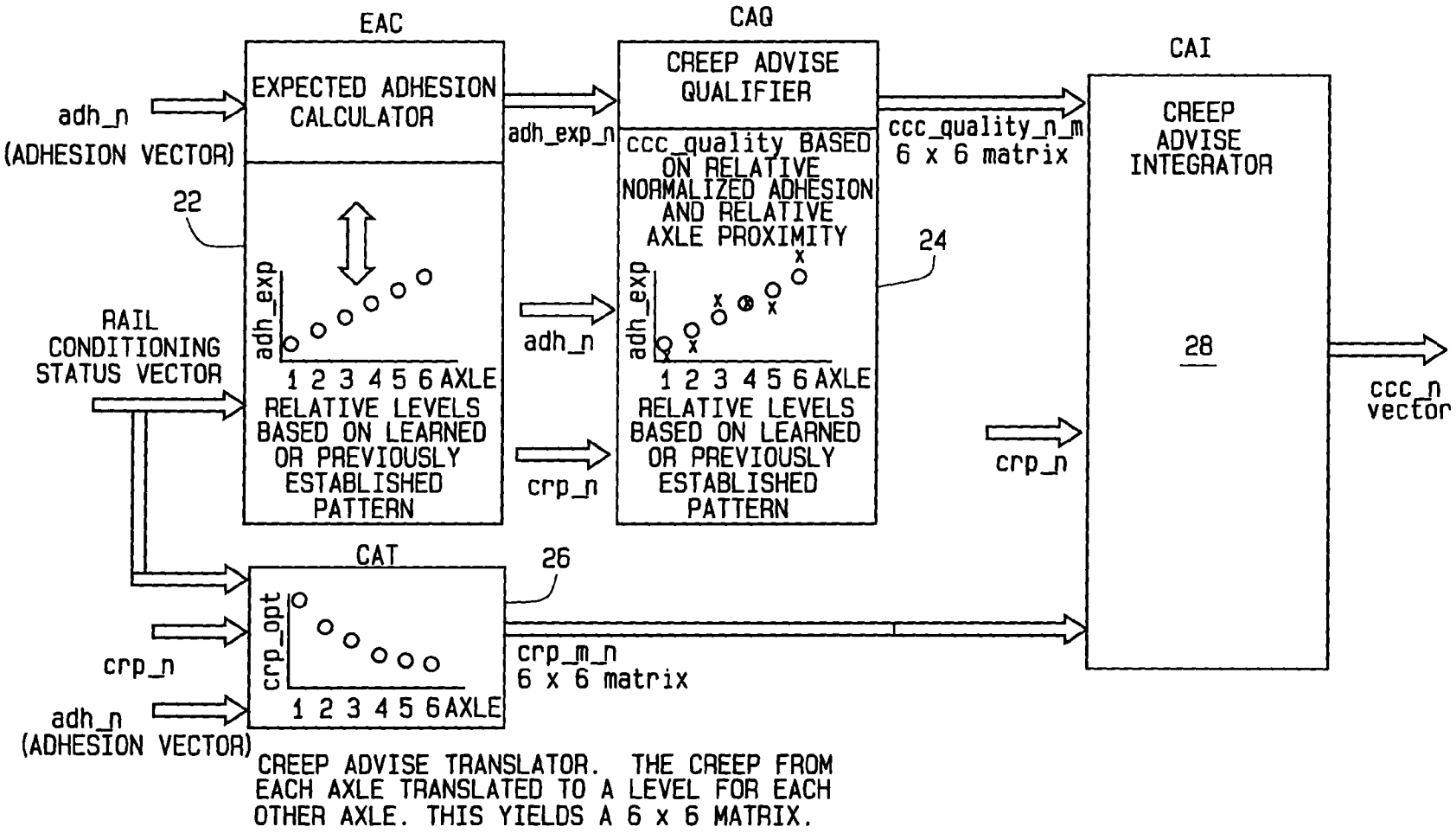
FIG. 12 is a block diagram of a portion of the coupled creep control unit illustrating normalization of the creep for one axle so the information can be used for another axle.

Before the creep level of one axle is used to influence that of another axle, the creep level value is first normalized. Referring to FIG. 12, coupled control unit 12 is shown to include an expected adhesion calculator (EAC) 22 to which is supplied an adhesion signal adh_n from calculator 20 (see FIG. 8). EAC 22 determines an optimal expected adhesion performance of each axle based on rail conditions, and locomotive static and dynamic characteristics. The calculator utilizes the relative adhesion history of an axle, as measured during creep limited operating modes. One result produced by calculator 22 is a function of the average level of adhesion for all of the creep limited axles, and an output of the EAC calculator is an expected adhesion value for each axle. Common mode changes, such as when the creep level of all six axles changes by the same amount (percentage), are incorporated into the vector signal adh_n supplied to the calculator. This signal, is processed by calculator 22 and supplied as an output of the calculator. Differential changes (e.g., the creep level changing by a different percentage for each axle) are initially not used by EAC calculator 22, by rather are processed to gain an understanding of how the axles function relative to each other under various rail conditions.

A second input to EAC calculator 22 is a rail condition status vector. This input provides information such as, for example, which axles are being sanded. This information includes the time at which each axle experiences these changes. For example, a condition effecting by axle A1 will then be experienced by axle A2 sooner if locomotive V is traveling at high speed rather than at low speed. This is important because it affects expected adhesion ratios.

A creep advice qualifier (CAQ) 24 determines the quality of the creep advice provided by one axle for use by another axle. The quality of advice is typically rated higher if the normalized adhesion (actual adhesion to expected adhesion) developed by the one axle is greater than that developed by the other axle. This means that the axle with the greater normalized adhesion value is performing better than the other axle; and, the other axle is, in effect, advised to use the creep advice provided by the axle with the higher normalized adhesion value. Conversely, if the axle is performing significantly worse than the other axle is, it would be advisable for the one axle to use the opposite sense of the creep advice provided by that axle.

Additionally, the relative proximity of the two axles also influences the quality of the creep advice. If the axles are adjacent axles, the advice provided by the one axle to the other is generally rated higher than if the axles are more separated, assuming other factors are equal.

One method for determining the quality of the advice provided by one axle to the other is set forth in general, and as an illustration, in Eq. 4 as follows:

$$\begin{aligned} \text{ccc_quality_y_z} &= \text{function}\{\text{q_adh_y_z, q_prox_y_z}\} \\ &= \min\{\text{q_adh_y_z} \times \text{q_prox_y_z, q_max}\} \end{aligned} \quad \text{(Eq. 4)}$$

Where, y and z are the axles under consideration;

q_adh_y_z is the quality of the creep advice provided by an axle y to an axle z based upon their relative normalized adhesion ratios and is calculated in accordance with Eq. 5 below;

q_prox y_z represents the quality of advice as a function of the proximity of the two axles and is calculated in accordance with Eq. 6 below; and, q_max is an upper limit for the magnitude of the result.

The second line of the above equation provides the example of its use.

As noted above, the quality of creep advice provided by an axle y to an axle z is based upon their relative normalized adhesion ratios and is calculated, in general and as an illustration, from Eq. 5 as follows:

$$q_adh_y_z = function\{q_adh_min, adh_y, adh_exp_y, adh_z, adh_exp_z\} = [\{\max(q_adh_min, (adh_y/adh_exp_y)/(adh_z/adh_exp_z) - 1\} \times K_3]^a \quad \text{(Eq. 5)}$$

where, a and $K_3$ effect the degree to which normalized adhesion ratios for the axles influence the quality of advise from the one axle to the other, q_adh_min is a minimum value. Again, the second line of the equation provides an example of its use.

Figure 13:
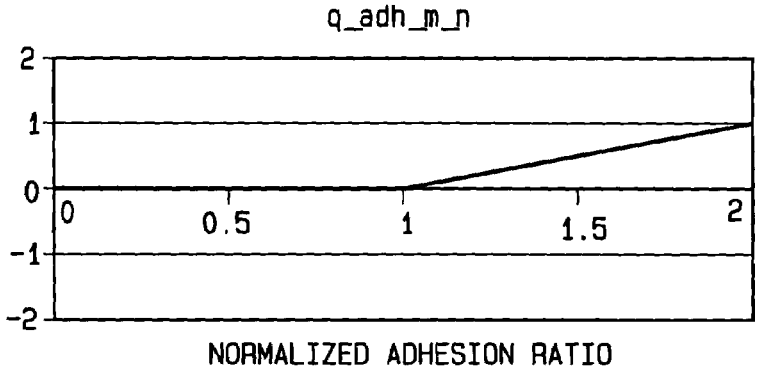
FIG. 13 is a graph of normalized adhesion ratios for two axles.

FIG. 13 is a graph illustrating how the value of q_adh_y_z is affected by the normalized adhesion ratios of the respective axles y and z. The plot in FIG. 13 is based on Eq. 5 with the factors a and $K_3$ both being equal to 1, and q_adh_min being equal to 0.

As further noted above, the proximity effect may be determined, in general and as an illustration, as follows using Eq. 6 as:

$$q_prox_y_z = function(y, z) = (1/abs(\max(y - z), 1))^P \quad \{y <> z\} \quad \text{(Eq. 6)}$$

where,

P represents the amount of influence one axle's creep value has on another axle based upon the proximity of the two axles. If y=z, then q_prox_y_z=0.

Figures 14, 15:
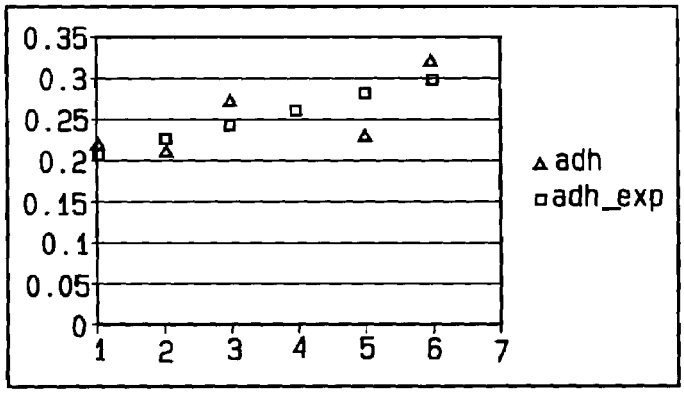
FIG. 14 is an example of a proximity quality matrix generated using the method of the present invention.
FIG. 15 is a representative set of values for the weight supported by each axle on a locomotive, and adhesion and expected adhesion values for these axles, and a plot of the resulting adhesion and expected adhesion curves.

FIG. 14 illustrates how the quality of advice varies with respect to the normalized adhesion ratio for a six axle locomotive V configuration. In this Figure, P=1. Accordingly, for each axle, the quality of advice for the adjacent axle is 1. However, as one moves further away from the subject axle, the value of the quality of the advice from the other axle rapidly declines.

Again, even though the creep advise is given by axles which are performing better compared to what is expected, it is also possible to give negative advise by axles performing poorly.

Referring again to FIG. 12, a creep advice translator (CAT) 26 has as inputs a creep value crp_n from each axle and the rail conditioning status vector that is also supplied to EAC calculator 22. Translator 26 adjusts each axle's creep value to a level for each of the other axles to produce a six by six matrix similar to that shown in FIG. 14.

FIGS. 15–17 illustrate development of the quality matrix using Eq. 4 for a six axle locomotive V configuration. In FIG. 15, the weight, adhesion (adh) and expected adhesion (adh_exp) values are given for each axle of the six axle configuration. The adhesion and expected adhesion values are then plotted on the accompanying graph.

Next, FIG. 16 is a 6×6 matrix whose values are calculated in accordance with Eq. 5. In viewing this matrix, it should be noted that in accordance with the invention, axles 3 and 6 have, in effect, advice to provide, and axle 5 is an axle which can use that advice.

FIG. 17 a also a 6×6 matrix calculated in accordance with Eq. 4. The values included in this matrix represent include consideration of both normalized adhesion and proximity.

A creep advice integrator (CAI) 28 has as inputs values representing the proximity quality matrix shown in FIG. 13, the creep signal crp_n for each axle, and the matrix produced by translator 26. Integrator 28 utilizes all of these inputs to produce the coupled creep control output ccc_n for each axle which is supplied to the tractive effort maximizer TEM1–TEM6 for the respective axle. The output vector ccc_n is calculated, in general and as an illustration, in accordance with Eq. 6, as follows:

$$ccc_y = function\{ccc_quality_y_z, crp_y_n - crp_n, crp_max_z, crp_min_z\} = \sum [ccc_quality_y_z \times (crp_y_n - crp_n) \times (crp_max_z - crp_min_z) \times K_{y_z}] \quad z = 1 - 6 \quad \text{(Eq. 6)}$$

where, ccc_quality_y_z is the quality of the creep advice from axle y for axle z;

crp_y_z is the creep advice from axle y for axle z;

crp_y is a creep set point for axle y;

crp_max_y is a maximum creep limit set by the tractive effort maximizer TEM1–TEM6 function for axle y;

crp_max_y is a minimum creep limit set by the tractive effort maximizer TEM1-TEM6 function for axle y; and, $K_{y\text{-}z}$ is a fixed or controlled gain factor that controls the strength of the CCC algorithm.

Figures 18, 19:
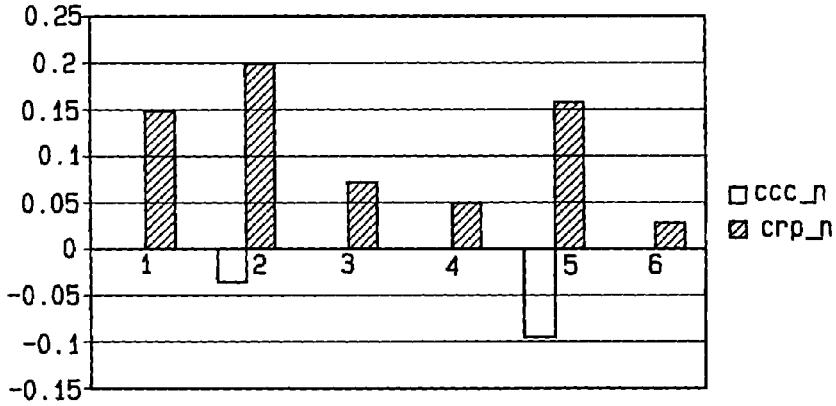
FIG. 18 is a chart of normalized creep and normalized expected creep values for each of the axles, and a 6×6 creep matrix based upon these values.
FIG. 19 is a graphic representation of how the resultant coupled creep control values ccc_n effect measured creep values crp_n for each axle; and, FIG. 20 is a simplified representation of two trains having multiple locomotives traveling over the same set of rails.

FIG. 18 further extends the six axle advice example of FIGS. 15–17. In FIG. 18, normalized creep and normalized expected creep values are provided for each of the six axles. The Figure further includes a 6×6 creep matrix based upon these values.

Finally, FIG. 19 is a graphic representation of how the resultant coupled creep control values ccc_n affect the measured creep values crp_n for each axle. The creep values plotted in FIG. 19 correspond to those values listed in the crp column of FIG. 18. The coupled creep control values are based upon the matrix information in FIG. 17. As shown in FIG. 19, the ccc_2 and ccc_5 signals provide by control 12 in FIG. 7 to the tractive effort maximizers TEM2 and TEM5 both are used to reduce the creep on each of these two axles, while the signals to the other four tractive effort maximizers have value which produce little, or no, effect on the creep for these respective axles.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A method of dynamically controlling the traction of wheels on a first axle on a locomotive in a train having one or more locomotives each having propulsion axles and wheels moving over a set of rails to reduce response time and increase locomotive traction, the method comprising:

measuring the adhesion quality of the first axle;

measuring the adhesion quality of at least one other axle of the train constituting a second axle; and, using data indicative of the adhesion quality of the second axle to produce a signal to advise a controller driving the first axle to maximize the tractive effort of the first axle if the tractive effort of the second axle is operating closer to a maximum for its current rail conditions so to reduce the amount of time for the first axle to attain its maximum tractive effort for its rail conditions.

2. The method of claim 1 wherein the first axle is positioned forward of the second axle in the direction of travel of the train.

3. The method of claim 1 in which said measuring the adhesion quality of the first axle on the locomotive and the second axle includes measuring one of the tractive effort, torque and creep of the axles.

4. The method of claim 1 in which the signal is a coupled creep control signal that is combined with other adhesion quality information to produce a creep control signal used to drive the first axle.

5. The method of claim 4 in which the coupled creep control signal is a function of the proximity of the first axle on the locomotive to the other axle.

6. The method of claim 1 in which the locomotive has a plurality of trucks on each of which axles are mounted, and the method includes combining values representative of the adhesion operation of all the axles mounted on one of the trucks to produce a signal supplied to controllers driving each of the axles on that truck to maximize the tractive effort of all the axles mounted on the truck in the least amount of time in response to changed rail conditions.

7. The method of claim 6 further including combining values representative of the adhesion quality of all of the axles mounted on all of the locomotive's trucks to maximize the tractive effort of all of the locomotive's axles in the least amount of time in response to said changed rail conditions.

8. The method of claim 7 further including combining adhesion quality information for each of the axles to produce a matrix of coupled creep control values, a coupled creep control signal supplied for each axle being derived from the matrix of coupled creep control values for all of the axles.

9. The method of claim 1 wherein the locomotive is one of a plurality of locomotives in a consist and the method further includes using the values representative of the adhesion quality of an axle mounted on one of the other locomotives to maximize the tractive effort of the axle mounted on the one other locomotive in the least amount of time in response to changed rail conditions.

10. The method of claim 9 in which the values representative of the adhesion quality of all of the axles mounted on the lead locomotive in the consist are used to maximize the tractive effort of the axles mounted on each trailing locomotive in the consist in the least amount of time in response to said changed rail conditions.

11. The method of claim 10 in which there are a plurality of consists traveling over the same set of rails and the method further includes using values representative of the adhesion quality of an axle mounted on a locomotive in the leading consist to maximize the tractive effort of the axle mounted on the locomotive in the leading consist in the least amount of time in response to changed rail conditions.

12. The method of claim 1 in which the method further includes using historic data about the respective axle to produce the signal.

13. The method of claim 1 further including using location specific information about the set of rails over which the locomotive is traveling to produce the signal.

14. The method of claim 13 further including using time specific information about the set of rails over which the locomotive is traveling to produce the signal.

15. In a railroad train having one or more locomotives, each having a plurality of axles on each of which are mounted wheels for moving the train over a set of rails and a traction motor controller for driving each respective axle to move the locomotive over the rails, the improvement comprising:

a control system for dynamically controlling traction associated with the axles of the one or more locomotives and including a coupled creep control unit to which is supplied adhesion quality information for an axle, and adhesion quality information for at least one other axle, the system producing a signal based upon the adhesion quality information of said one other axle to advise a controller driving the axle to maximize the tractive effort of the axle if the other axle is operating closer to a maximum for its rail conditions so to reduce the amount of time for the axle to attain its maximum tractive effort.

16. The improvement of claim 15 wherein the axle is located forward of the other axle in the direction of travel of the train.

17. The improvement of claim 15 in which the coupled creep control unit utilizes adhesion quality information for the axle on the locomotive and the other axle which includes at least one of the tractive effort, torque and creep of the respective axles.

18. The improvement of claim 17 in which the coupled creep control unit produces a signal that is a function of the proximity of two axles to each other.

19. The improvement of claim 15 in which the locomotive has a plurality of trucks on each of which a plurality of axles are mounted, and the control system combines values representative of the adhesion quality of all of the axles mounted on one of the trucks to produce a signal supplied to controllers driving each of the axles on that truck to maximize the tractive effort of the axles mounted on the truck.

20. The improvement of claim 19 wherein the control system combines values representative of the adhesion quality of all of the axles mounted on all of the locomotives' trucks to maximize the tractive effort of all of the locomotives' axles.

21. The improvement of claim 20 wherein the control system further combines adhesion quality information for each of the axles to produce a matrix of coupled creep control values, a coupled creep control signal supplied for each axle being derived from the matrix of coupled creep control values for all of the axles.

22. The improvement of claim 15 wherein the locomotive is one of a plurality of locomotives in a consist and the control system combines values representative of the adhesion quality of an axle mounted on one of the other locomotives to maximize the tractive effort of the axle mounted on said one another locomotive.

23. The improvement of claim 22 in which the control system combines values representative of the adhesion quality of all of the axles mounted on the lead locomotive in the consist to maximize the tractive effort of the axles mounted on each of the trailing locomotives in the consist.

24. The improvement of claim 22 in which there are a plurality of consists traveling over the same set of rails and the control system combines values representative of the adhesion quality of an axle mounted on a locomotive in the leading consist to maximize the tractive effort of the axle mounted on the one locomotive in the leading consist.

25. The improvement of claim 15 in which the control system uses historic data about the respective axle to produce the signal.

26. The improvement of claim 25 wherein the control system further uses location specific information about the set of rails over which a locomotive in a lending consist is traveling to produce the signal.

27. The improvement of claim 26 wherein the control system uses time specific information about the set of rails over which the locomotive is in a lending consist traveling to produce the signal.

28. A method of dynamically controlling the traction of an axle on a locomotive moving over a set of rails to reduce response time and increase locomotive traction, the method comprising:

measuring the adhesion quality of an axle for its rail conditions;

accessing historic information regarding the adhesion quality of the other axles under corresponding rail conditions; and, using data indicative of the measured adhesion quality of the axle and the historic information of adhesion quality for the other axles to produce an advisory signal for a controller driving the axle to maximize the tractive effort of the axle and reduce the amount of time for the axle to attain its maximum tractive effort.

29. In a railroad train having one or more locomotives, each having a plurality of axles on each of which are mounted wheels for moving the train over a set of rails and a traction motor controller for driving each respective axle to move the locomotive over the rails, the improvement comprising:

a control system for dynamically controlling traction associated with the axles of the locomotives and including a coupled creep control unit to which is supplied adhesion quality information for an axle and historic information regarding the adhesion quality of the other axles under corresponding rail conditions, the control system using data indicative of the measured adhesion quality of the axle and the historic information of adhesion quality for the other axles to produce an advisory signal for the controller driving the axle to maximize the tractive effort of the axle and reduce the amount of time for the axle to attain its maximum tractive effort.

* * * * *